US007377340B2

(12) United States Patent
McDonough

(10) Patent No.: US 7,377,340 B2
(45) Date of Patent: May 27, 2008

(54) DRILL BIT CUTTING ELEMENTS WITH SELECTIVELY POSITIONED WEAR RESISTANT SURFACE

(75) Inventor: Scott D. McDonough, Houston, TX (US)

(73) Assignee: Smith International, Inc., Houston, TX (US)

( * ) Notice: Subject to any disclaimer, the term of this patent is extended or adjusted under 35 U.S.C. 154(b) by 260 days.

(21) Appl. No.: 10/977,351

(22) Filed: Oct. 29, 2004

(65) Prior Publication Data

US 2006/0090937 A1 May 4, 2006

(51) Int. Cl.
*E21B 10/16* (2006.01)

(52) U.S. Cl. ..... 175/374; 175/426

(58) Field of Classification Search ..... 175/374, 175/426

See application file for complete search history.

(56) References Cited

U.S. PATENT DOCUMENTS 3,800,891 A * 4/1974 White et al. ..... 175/374
5,131,480 A * 7/1992 Lockstedt et al. ..... 175/374
5,445,231 A * 8/1995 Scott et al. ..... 175/374
5,579,856 A * 12/1996 Bird ..... 175/375
6,029,759 A * 2/2000 Sue et al. ..... 175/374
6,766,870 B2 * 7/2004 Overstreet ..... 175/374
2002/0100620 A1 * 8/2002 Singh et al. ..... 175/374
2002/0162691 A1 * 11/2002 Fang et al. ..... 175/374

* cited by examiner

*Primary Examiner*—Hoang Dang
(74) *Attorney, Agent, or Firm*—Connolly Bove Lodge & Hutz LLP

(57) ABSTRACT

Drill bits comprise a plurality of steel cutting teeth each having a crest positioned at a tip portion of each tooth, a first flank surface extending from the crest to the cone, a second flank surface opposite the first flank surface and extending from the crest to the cone, and edge surfaces extending from the crest to the cone and interposed between the first and second flank surfaces. Each cutting tooth includes corners that extend from the crest to the cone that are defined by the interface between the first and second flank surfaces and the edge surfaces. A wear resistant surface is positioned on selective tooth surfaces comprising at least the crest and a portion of one or more of the corners. The wear surface is not disposed on at least a surface portion of one of the first and second flank surfaces and the edge surfaces.

27 Claims, 6 Drawing Sheets

PRIOR ART 28
32
42
34
38
36
40
30

DRILL BIT CUTTING ELEMENTS WITH SELECTIVELY POSITIONED WEAR RESISTANT SURFACE

FIELD OF THE INVENTION

This invention relates to roller cone bits comprising a number of outwardly projecting cutting elements for subterranean drilling and, more particularly, to milled tooth bits comprising steel teeth having one or more selective surfaces protected by a wear resistant surface for the purpose of providing a desired degree of protection against known wear-related service failure, thereby beneficially impacting rate of penetration (ROP) when compared to conventional hardfaced drill bits.

BACKGROUND OF THE INVENTION

Rock bits used for drilling oil wells and the like commonly have a steel body that is connected at the bottom of a drill string. Steel cutter cones are mounted on the body for rotation and engagement with the bottom of a hole being drilled to crush, gouge, and scrape rock for drilling the well. One important type of rock bit, referred to as a "milled tooth" bit, has roughly trapezoidal teeth protruding from the surface of the cone for engaging the rock.

Conventional milled teeth are made from steel, and are "hardfaced" for the purpose of providing an improved level of wear protection. Such milled teeth can be completely hardfaced, or be selectively hardfaced to provide a desired self-sharpening effect during drill bit operation. While conventional completely hardfaced teeth are known to offer an adequate level of protection to the underlying steel tooth during the drilling operation, the placement of hardfacing over the entire tooth increases the effective area of the tooth is theorized to have a limiting effect on the ROP.

Conventional self-sharpening teeth are specifically designed having hardfacing disposed along strategic surface areas of the teeth to produce a preferential wearing of the nonhardfaced surfaces. While this combination of wear protected and preferential wearing surfaces produces a sharpened structure known to improve ROP, it is known that some of the nonhardfaced surfaces can leave the teeth vulnerable to erosion cracking, which can eventually cause the teeth to break. Such breakage can have a detrimental impact on achieving the desired ROP.

The term "hardfaced" is understood in industry to refer to the process of applying a carbide-containing steel material (i.e., conventional hardmetal) to the underlying steel substrate by welding process, as is better described below. Thus, the terms "hardfaced layer" or "hardfacing" are understood as referring to the layer of conventional hardmetal that is welded onto the underlying steel substrate.

Conventional hardmetal materials used to provide wear resistance to the underlying steel substrate usually comprise pellets or particles of cemented tungsten carbide (WC—Co) and/or cast carbide particles that are embedded or suspended within a steel matrix. The carbide materials are used to impart properties of wear resistance and fracture resistance to the steel matrix. Conventional hardmetal materials useful for forming a hardfaced layer on bits may also include one or more alloys to provide one or more certain desired physical properties. As mentioned above, the hardfaced layer is bonded or applied to the underlying steel teeth by a welding process.

The hardfaced layer is conventionally applied onto the milled teeth by oxyacetylene or atomic hydrogen welding.

The hardfacing process makes use of a welding "rod" or stick that is formed of a tube of mild steel sheet enclosing a filler which is made up of primarily carbide particles. The filler may also include deoxidizer for the steel, flux and a resin binder. The relatively wear resistant filler material is typically applied to the underlying steel tooth surface, and the underlying tooth surface is thus hardfaced, by melting an end of the rod on the face of the tooth. The steel tube melts to weld to the steel tooth and provide the matrix for the carbide particles in the tube. The deoxidizer alloys with the mild steel of the tube.

While this hardfacing process is effective for providing a good bond between the steel substrate and the conventional hardmetal material, it is a relatively crude process that is known to adversely impact the performance properties of the hardfaced layer. The hardfacing welding process itself generates certain welding byproducts that can and does enter the applied material to produce an inconsistent material microstructure. For example, the welding process is known to introduce oxide inclusions and eta-phases into the applied material, which function to disrupt the desired material microstructure. Such disruptions or inconsistencies in the material microstructure are known to cause premature chipping, flaking, fracturing, and ultimately failure of the hardfaced layer. Additionally, the welding process and associated thermal impact of the same can cause cracks to develop in the material microstructure, which can also cause premature chipping, flaking, fracturing, and ultimately failure of the hardfaced layer.

Additionally, the hardfacing process of welding the carbide-containing steel material onto the underlying substrate makes it difficult to provide a hardfaced layer having a consistent coating thickness, which ultimately governs the rate of wear loss for the steel material, and the related service life of bit.

Example conventional hardmetal materials, useful for forming a conventional hardfaced layer, typically comprise in the range of from about 30 to 40 percent by weight steel, and include carbide pellets and/or particles having a particle size in the range from about 200 to 1,000 micrometers. Examples of conventional materials used for forming hardfaced layers can be found in U.S. Pat. Nos. 4,944,774; 5,663,512; and 5,921,330. The combination of relatively high steel content and large carbide particle size for such conventional hardmetal materials dictate that the mean spacing between the carbide pellets within the steel matrix be relatively large, e.g., greater than about 10 micrometers. It is believed that this relatively large mean spacing of carbide particles within the conventional hardmetal material causes preferential wear of the steel matrix that is known to lead to uprooting and removal of the carbide particles. Such wear loss is known to occur along the milled tooth tip at high stress locations during drilling and functions to accelerate loss of the hardfacing, which is a predominant failure mechanism for hardfaced bit surfaces, thereby limiting the service life of such bits.

It is, therefore, desirable that a milled tooth be constructed in a manner providing a desired degree of wear resistance against erosion, while at the same time providing improved ROP when compared to conventional completely hardfaced milled teeth and conventional self-sharpening milled teeth. It is desired that such milled tooth be capable of providing a self-sharpening feature. It is desired that the milled teeth be constructed having a wear and fracture resistant material alternative to conventional hardfacing that avoids the undesired effects of hardfacing, e.g., that avoids the undesired impact on the material microstructure due to the thermal effect and introduction of unwanted byproducts inherent in the welding process, that can adversely impact drill bit surface performance properties. It is desired that such alternative wear and fracture resistant material be designed and/or applied onto the surface of a rock bit in such a manner as to provide improved properties of dimensional consistency and accuracy, e.g., a substantially consistent wear resistant surface thickness, when compared to conventional hardfaced materials. It is also desired that such wear and fracture resistant material be engineered in such a manner as to avoid the problem of preferential wear loss that is inherent to conventional hardmetal materials.

SUMMARY OF THE INVENTION

Cutting elements, constructed according to the principles of this invention, are configured for use with subterranean drill bits, e.g., rotary cone drill bits. The cutting elements can be provided in the form of steel milled teeth that are attached to cones rotatably mounted on the drill bit. The teeth project outwardly from the cone and each have a structure comprising a crest positioned at a tip portion of each tooth, and a number of surfaces extending therefrom towards the cone.

In an example embodiment, each tooth comprises a first flank surface extending from the crest to the cone, a second flank surface opposite from the first flank surface and extending from the crest to the cone, and edge surfaces that extend from the crest to the cone and that are interposed between the first and second flank surfaces. Each tooth also includes corners that extend from the crest to the cone, and that are defined by the interface between the first and second flank surfaces and the edge surfaces.

A key feature of cutting elements, e.g., milled teeth, of this invention is that they include a wear resistant surface positioned on selective surface portions of the teeth for the purpose of providing improved wear resistance without detrimentally impacting ROP. In an example embodiment, the wear surface is disposed on at least the crest and a portion of one or more of the corners. The wear surface is intentionally not positioned along at least a portion of one or more of the first and second flanks and the edges for the purpose of controlling tooth surface area and, thereby not adversely impacting ROP. The wear resistant surface can be formed from conventional hardfacing or can be formed from other types of materials such as cermet materials and cermet composite materials.

DESCRIPTION OF THE DRAWINGS

These and other features and advantages of the present invention will be appreciated as the same becomes better understood by reference to the following detailed description when considered in connection with the accompanying drawings wherein.

DETAILED DESCRIPTION OF THE INVENTION

Roller cone drill bits of this invention comprise a plurality of cutting elements in the form of steel milled teeth that include a wear resistant surface positioned along selectively positioned teeth surface portions to both provide a desired degree of wear resistance and an improved ROP when compared to conventional completely hardfaced milled teeth and hardfaced self-sharpening milled teeth. The wear resistant surface can be provided in the form of conventional hardfacing, or can be provided in the form of functionally-engineered wear and fracture resistant materials capable of being applied without using a conventional hardfacing application process, i.e., without welding.

Such functionally-engineered wear and fracture resistant materials can have random or oriented material microstructures that are specifically designed to provide wear and fracture resistant properties tailored for particular applications. These materials can be in the form of cermets and/or composite cermets that are functionally engineered, in terms of the material constituents and/or final material microstructure, to provide superior properties of wear and fracture resistance when compared to conventional hardmetal materials. Thus, the composite cermet and cermet wear and fracture resistant materials act to overcome the failure mechanism discussed above of material wear loss associated with hardfaced layers formed from conventional hardmetal materials.

Figure 1:
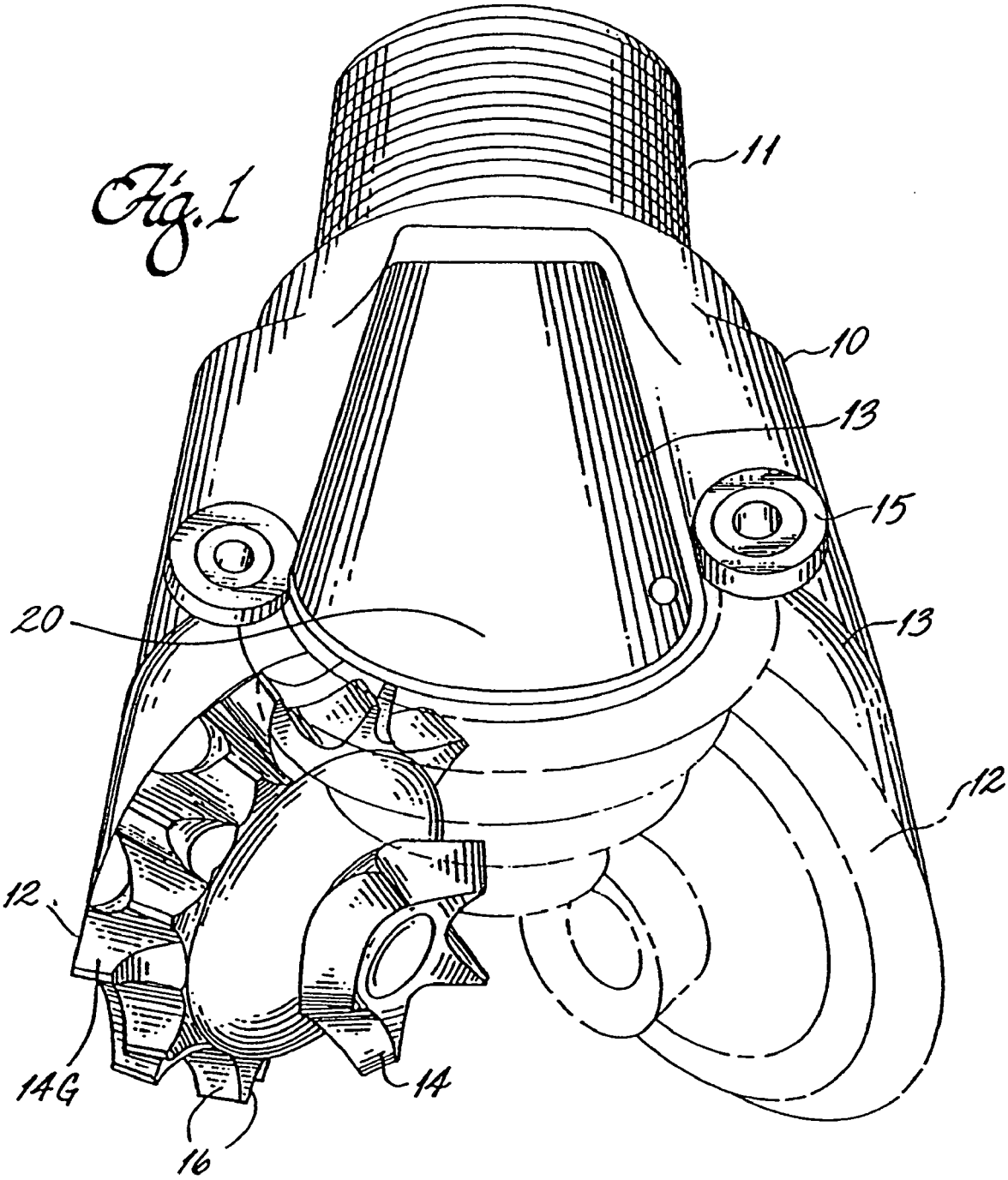
FIG. 1 is a schematic illustration of a rotary cone drill bit comprising a plurality of milled teeth of this invention.

FIG. 1 illustrates an example milled tooth drill bit, e.g., a rock bit, comprising a stout steel body 10 having a threaded pin 11 at one end for connection to a conventional drill string. At the opposite end of the body there are three cutter cones 12 for drilling rock for forming an oil well or the like. Each of the cutter cones are rotatably mounted on a pin (hidden) extending diagonally inwardly on one of the three legs 13 extending downwardly from the body of the rock bit. As the rock bit is rotated by the drill string to which it is attached, the cutter cones effectively roll on the bottom of the hole being drilled. The cones are shaped and mounted so that as they roll, teeth 14 on the cones gouge, chip, crush, abrade, and/or erode the rock at the bottom of the hole. The teeth 14 in the row around the heel of the cone are referred to as the gage row teeth. They engage the bottom of the hole being drilled near its perimeter on "gage." Fluid nozzles 15 direct drilling mud into the hole to carry away the particles of rock created by the drilling.

Such a rock bit is conventional and merely typical of various arrangements that may be employed in a rock bit. For example, most rock bits are of the three cone variety illustrated. However, one, two and four cone bits are also known. The arrangement of teeth on the cones is just one of many possible variations. In fact, it is typical that the teeth on the three cones on a rock bit differ from each other so that different portions of the bottom of the hole are engaged by the three cutter cones so that collectively the entire bottom of the hole is drilled. A broad variety of tooth and cone geometries are known and do not form a specific part of this invention.

Figure 2A:
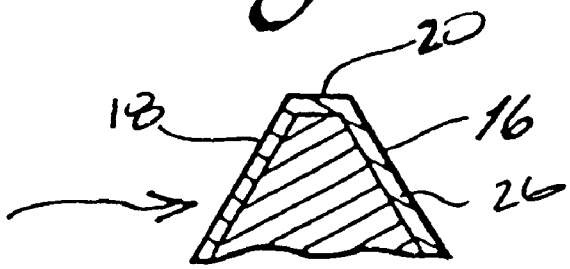
FIG. 2A is a fragmentary cross section of a prior art hardfaced tooth from a milled tooth rock bit.
Figure 2B:
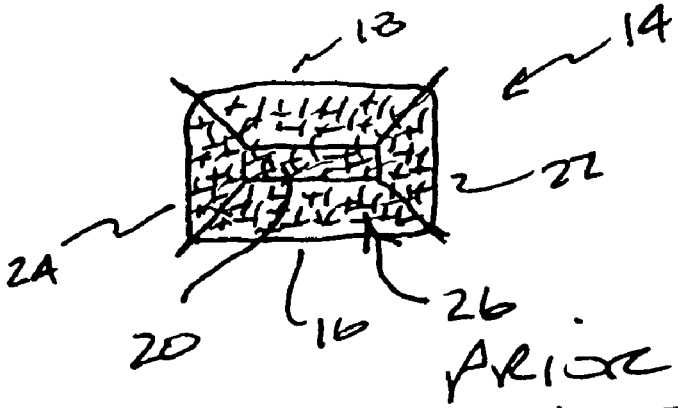
PRIOR ART FIG 2B
FIG. 2B is a schematic plan view of the prior art hardfaced tooth of FIG. 2A FIGS. 3A to 3C are schematic illustrations of a first embodiment milled tooth of this invention from different perspectives.

FIGS. 2A and 2B illustrate a prior art milled tooth 14 having a generally trapezoidal cross section when taken from a radial plane of the cone. Such a tooth has a leading flank or surface 16 and an oppositely oriented trailing flank or surface 18, each meeting one another along an elongated crest 20 forming a tip of the tooth. Side edge surfaces 22 and 24 are positioned along side portions of the tooth between the leading and trailing surfaces. For a conventional completely hardfaced tooth, a hardfaced layer 26 is disposed over substantially the entire tooth surface area.

The leading face of the tooth is the face that tends to bear against the undrilled rock as the rock bit is rotated in the hole. Because of the various cone angles of teeth on a cutter cone relative to the angle of the pin on which the cone is mounted, the leading flank on the teeth in one row on the same cone may face in the direction of rotation of the bit, whereas the leading flank on teeth in another row may, on the same cone, face away from the direction of rotation of the bit. In other cases, particularly near the axis of the bit, neither flank can be uniformly regarded as the leading flank and both flanks may be provided with a hardfaced layer.

The basic structure of a milled tooth rock bit is well known and does not form a specific portion of this invention, which relates to milled tooth bits having wear resistant material surfaces disposed onto selected tooth surface portions, and methods for forming the same.

Generally speaking, for the effective use of a rock bit, it is important to provide as much wear resistance as possible on the teeth. The effective life of the cone is enhanced as wear resistance is increased. It is desirable to keep the teeth protruding as far as possible from the body of the cone since the ROP of the bit into the rock formation is enhanced by longer teeth (however, unlimited length is infeasible since teeth may break if too long for a given rock formation). As wear occurs on the teeth, they get shorter and the drill bit may be replaced when the ROP decreases to an unacceptable level. It is, therefore, desirable to minimize wear so that the footage drilled by each bit is maximized. This not only decreases direct cost, but also decreases the frequency of having to "round trip" a drill string to replace a worn bit with a new one.

The conventional approach has been to provide a wear resistant surface in the form of hardfacing over the entire tooth. This, however, increases the cross-sectional surface area of the tooth, which is theorized to have a slowing effect on the ROP. Cutting elements of this invention, e.g., provided in the form of milled teeth, comprise a wear resistant surface that is strategically positioned along one or more desired surface portions to provide a desired degree of wear resistance to select portions of the milled tooth without unnecessarily adding to the cross-sectional thickness of the tooth, thereby providing an optimal ROP.

Figures 3A, 3B, 3C:
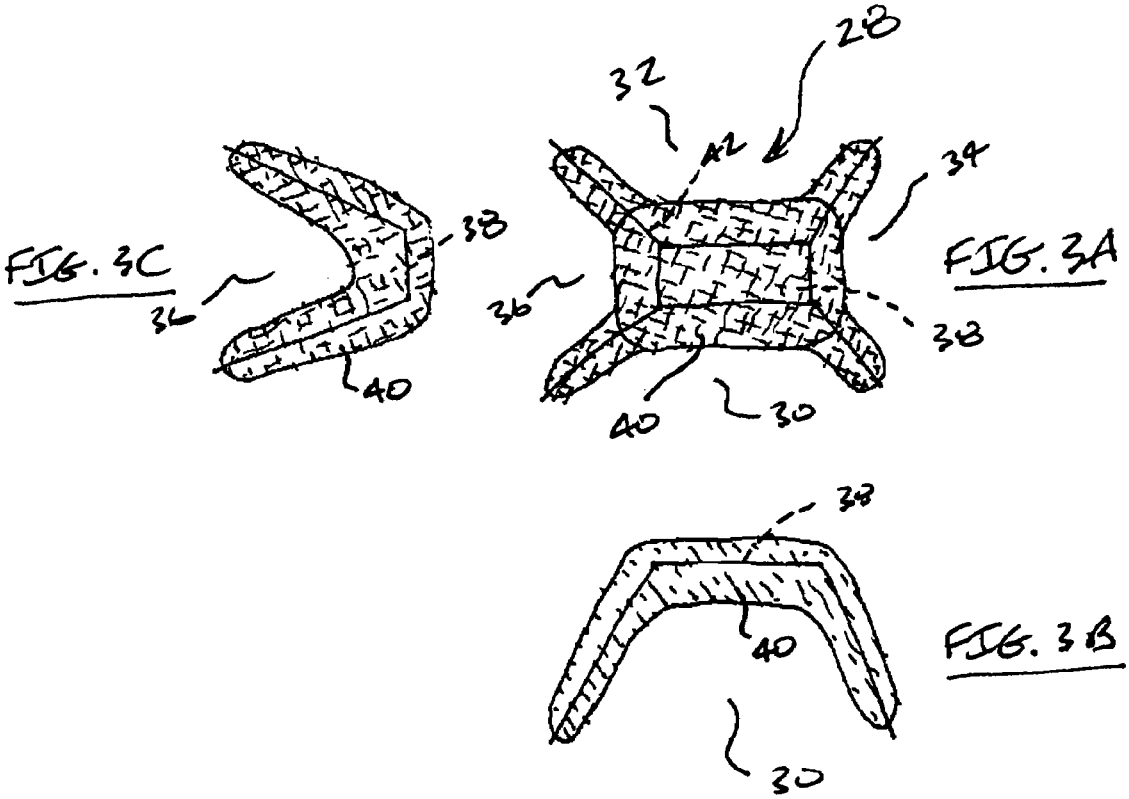
Figure 4C:
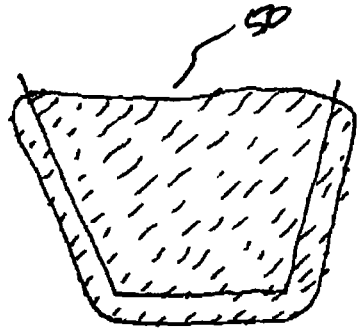
FIGS. 4A to 4D are schematic illustrations of a second embodiment milled tooth of this invention from different perspectives.
Figure 4D:
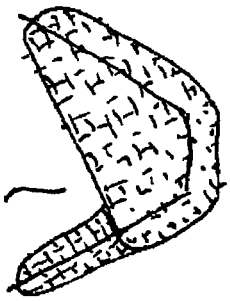
Figure 4A:
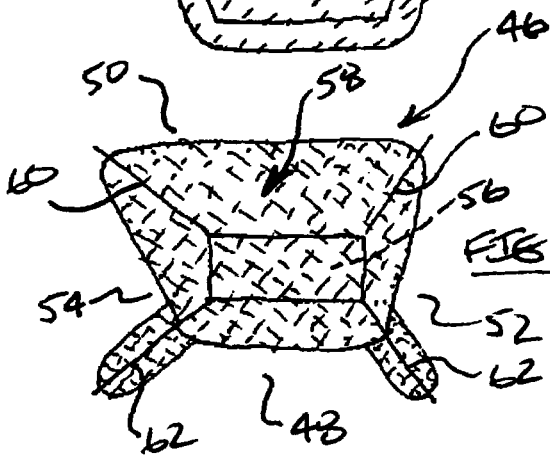
Figure 4B:
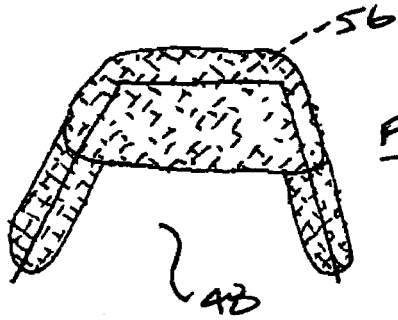

FIGS. 3A to 3C illustrate a first embodiment milled tooth 28, constructed according to principles of this invention, comprising a leading flank or surface 30, a trailing flank or surface 32, and edge surfaces 34 and 36 that are positioned therebetween. The milled tooth includes a crest 38 at the junction formed between the leading and trailing surfaces. A wear resistant material 40 is positioned over strategically identified surface portions of the tooth to provide a desired degree of protection against the abrasive downhole environment.

Specifically, in this first embodiment, the wear resistant material is positioned to cover the entire crest surface. Additionally, the wear resistant material can be positioned to extend from the crest onto a portion of one or all of the leading, trailing, and edge surfaces. The exact amount of coverage onto these leading, trailing, and edge surfaces can vary depending on such factors as the particular drill bit size, the size and shape of the milled teeth, the material used to form the teeth, and the drill bit application.

In an example embodiment, the wear resistant material is positioned to cover the crest to protect it against unwanted erosion during drilling. The wear resistant material can extend from the crest to cover an adjoining portion of one or more of the leading, trailing, and/or edge surfaces. In an example embodiment, the wear resistant material can extend from the crest to cover up to about ⅓ of the distance (moving from the crest to the cone) of one or more adjoining leading, trailing, and/or edge surfaces for the purpose of ensuring adequate protection of the crest. In an example embodiment, the wear resistant material extends from the crest to cover up to about ⅓ the distance of each of the leading, trailing, and edge surfaces. A milled tooth comprising the wear resistant material on the crest that covers greater than about ⅓ of an adjoining leading, trailing, and/or edge surface portion, while arguably providing an improved level of wear resistance, may increase the surface area of the tooth in a manner that detrimentally impacts ROP. Accordingly, the amount of wear resistant material extending from the crest to the adjoining leading, trailing, and/or edge surfaces represents a compromise between the amount of wear resistance needed to provide enhanced service life without detrimentally impacting ROP.

The wear resistant material is also preferably disposed over at least a portion of the corners 42 that are formed at the points where the leading and trailing flanks are joined to the edge surfaces. In an example embodiment, the wear resistant material 40 is disposed along a substantial portion of each of the four corners 42 that extend from the crest to the cone surface. Placement of the wear resistant material on the corners is desired because the corners are known to be especially vulnerable to the effects of erosion during the drilling operation. Again, as with the crest and surrounding surface portions, it is desired that the placement of the wear resistant material be strategic for the purpose of providing an improved degree of wear resistance without sacrificing ROP. In an example embodiment, the wear resistant material is disposed along at least 75 percent of each corner length, as measured extending from the crest towards the cone surface.

As shown in FIGS. 3A to 3C, the remaining portions of the milled tooth leading flank, trailing flank, and edge surfaces are not covered with the wear resistant material. Thus, the milled tooth configured in this matter has a wear resistant material disposed only over those surface areas/features of the tooth believed necessary to provide a degree of improved wear resistance to achieve a desired ROP without unduly increasing the cross-sectional area of the tooth, which can operate to reduce ROP.

The approach of this invention can also be used to optimize the ROP performance of conventional self-sharpening milled teeth that are configured to include hardfacing that has been selectively positioned along the tooth surface to provide a self-sharpening effect as the drill bit is operated and the unprotected portion of the tooth is worn. The selective placement typically includes placement over the crest and partial placement over the leading flank surface. Self-sharpening milled teeth are not known to include coverage over a substantial length of all of the corners.

FIGS. 4A to 4D illustrate a second embodiment milled tooth 46, constructed in accordance with the principles of this invention, to provide a self-sharpening effect. The tooth 46 includes a leading flank surface 48, a trailing flank surface 50, edge surfaces 52 and 54 that are positioned therebetween, and a crest 56 that is positioned where the leading and trailing flanks are joined together.

A wear resistant material 58 is positioned over strategically identified surface portions of the tooth 46 to provide both a desired degree of wear resistance and self-sharpening to the tooth. In an example embodiment, the wear resistant material 58 is disposed over the crest 56 and over an adjacent portion of the leading flank, trailing flank, and edge surfaces, as discussed above for the first embodiment. In this embodiment, however, the wear surface also extends from the crest a defined distance over the leading flank 48 to produce a desired self-sharpening effect. The amount by which the wear resistant material covers the leading flank can and will vary depending on many different factors. In an example embodiment, it is desired that the wear resistant material extend along at least ¼ of the leading flank surface length, as measured from the crest.

As the drill bit is operated, the portion of the leading flank extending from the cone surface and not covered with the wear resistant material becomes worn away. When coupled to the portion of the leading flank adjacent the crest that is protected by the wear resistant material, this selectively located wearing operates to form a relatively sharp surface feature.

The wear resistant material 58 also extends from the crest over a portion of the trailing flank surface 50. In an example embodiment, the wear resistant material can extend over greater than about ⅓ of the trailing flank surface length, as measured from the crest. In an example embodiment, the length of the trailing flank surface covered by the wear resistant material can be at least 50 percent and, more preferably, at least 75 percent. This particular embodiment is useful in those drilling applications know to suffer severe erosion along the trailing flank surface.

A further feature of such extended coverage over the trailing flank surface is that the corners defined between the trailing flank surface and the two adjoining edge surfaces are also covered. As discussed above, coverage of these corners is desired for the purpose of protecting the same against unwanted erosion-related cracking, which could ultimately cause the tooth to break.

The amount of wear resistant material coverage over the edge surfaces 52 and 54 depends on the amount of coverage over the leading and trailing flank surfaces. As illustrated, the wear resistant material disposed over the edge surfaces traverse each surface from opposed leading and trailing flank surfaces. In the embodiment illustrated, because the amount of coverage over the leading flank is less than that of the trailing flank, the wear resistant material coverage of each edge surface increases moving from the leading to the trailing flank surfaces.

As shown in FIGS. 4A to 4D, and for the reasons discussed above with respect to the first embodiment, it is also desired that the wear resistant material 58 be disposed over the corners 62 of the milled tooth defined between the leading flanks surface 48 and the adjoining edges surfaces. In an example embodiment, the wear resistant material 58 is disposed along a substantial portion of each of the four corners 60 and 62 that extend from the crest to the cone surface. In an example embodiment, the wear resistant material is disposed along at least 75 percent of each corner length in this second embodiment, as measured extending from the crest.

As shown in FIGS. 4A to 4D, the remaining portions of the milled tooth leading flank and edge surfaces are not covered with the wear resistant surface, and this selective coverage operates to provide a self-sharpening effect during drill bit operation. The milled tooth configured in this matter has a wear resistant surface disposed only over those surface areas/features of the tooth believed necessary to provide a degree of improved wear resistance to achieve a desired ROP without unduly increasing the cross-sectional thickness of the tooth, which can operate to reduce ROP.

It is understood that material used to form the desired wear resistant surface is disposed onto the selectively positioned cutting element surface portions while the cutting element, e.g., a milled tooth, is already in a rigid state, i.e., is in a pre-existing rigid state. For example, milled teeth can either be forged and machined from steel bars (i.e., in the form of wrought or casting stock), or can be sintered from metal powders (i.e., in the form of a fully- or partially-densified substrate).

The wear resistant surfaces provided on cutting elements of this invention can include those formed from conventional hardfacing, and those formed from other wear resistant materials, e.g., cermet materials, and functionally-engineered wear resistant materials. In an example embodiment, the wear resistant material can be formed from a material comprising a plurality of hard phase grains bonded together by a binder phase. The hard phase grains can be selected from the group of materials including W, Ti, Mo, Nb, V, Hf, Ta and Cr carbides, and the binder phase can be selected from the group of materials including steel, Co, Ni, Fe, C, B, Cr, Si, Mn and alloys thereof. In an example embodiment of this example, the hard grains are WC and the binder phase is Co.

Figure 5:
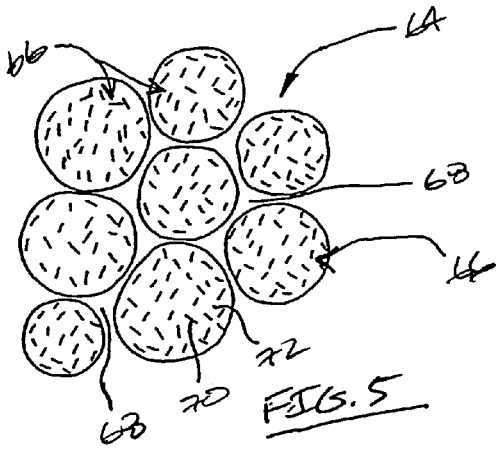
FIG. 5 is a schematic representation of a material microstructure of a functionally-engineered wear and fracture resistant composite cermet material surface used to form milled teeth of this invention.

In another example embodiment, the wear resistant surface is formed from a composite cermet. Referring to FIG. 5, as used in herein, the term "composite cermet" is intended to refer to a material having a microstructure 64 comprising a plurality of cermet first regions 66 distributed within a matrix of a second relatively more ductile region 68 that separates the first regions from one another. The term "cermet," as used herein, is understood to refer to those materials having both a ceramic and a metallic constituent. Each cermet first region 66 comprises a composite of hard grains 70 or particles and a ductile binder phase 72 bonding the particles together.

The hard grains 70 or particles can be selected from the group of carbides consisting of W, Ti, Mo, Nb, V, Hf, Ta, and Cr carbides. The ductile binder phase 72 can be selected from the group consisting of Co, Ni, Fe, C, B, Cr, Si, Mn and alloys thereof. Materials useful for forming the cermet first phase regions 66, e.g., WC—Co, can have an average particle size in the range from about 30 to 1,000 micrometers. The second ductile region 68 can be selected from the group consisting of steel, Co, Ni, Fe, W, Mo, Ti, Ta, V, Nb, C, B, Cr, Mn, and alloys thereof.

An example cermet first region 66 comprises tungsten carbide grains 70 that are cemented or bonded together with cobalt as the ductile binder phase 72, i.e., WC—Co. An example second ductile region 68 can be cobalt or steel. Such composite cermet material may comprise in the range of from 15 to 80 percent by volume of the second ductile region, e.g., cobalt or steel, and a remaining amount cermet first phase regions, e.g., WC—Co pellets. Composite cermet materials useful for forming functionally-engineered wear and fracture resistant materials, and methods for making the same, for use in forming wear resistant surfaces on a milled tooth include but are not limited to the composite cermet materials as described in U.S. Pat. No. 5,880,382, which is incorporated herein by reference The types of materials that are selected to form the cermet first region and the second ductile region, the particle sizes of cermets used to form the cermet first regions, and the relative volume of cermet first regions used to form the above-described composite cermet material is understood to vary depending on the particular drilling application for rotary cone drill bits comprising milled teeth of this invention.

Figure 6:
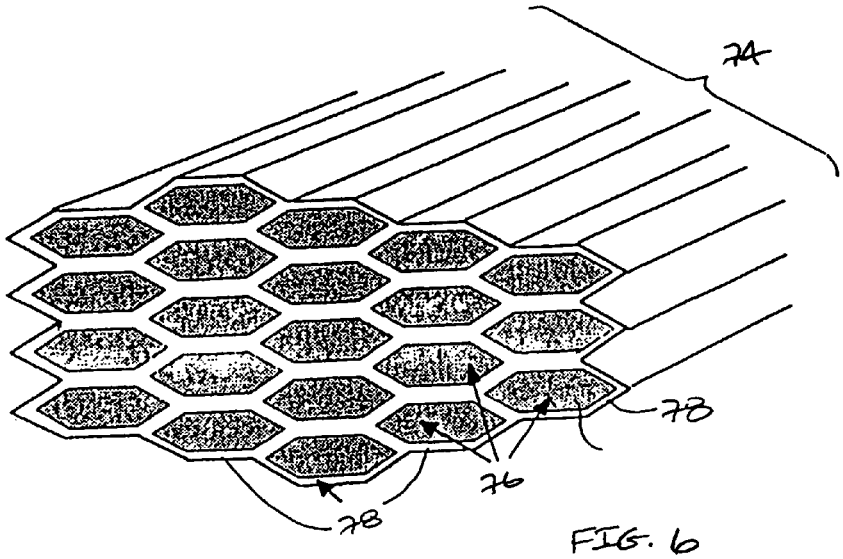
FIG. 6 is a schematic representation of a material microstructure of a functionally-engineered wear and fracture resistant composite cermet material surface used to form milled teeth of this invention.

As an alternative to the composite cermet materials described above, wear and fracture resistant materials useful for forming milled teeth of this invention can include a composite cermet having an ordered or oriented material microstructure of two or more different materials phases as described in U.S. Pat. No. 6,063,502, which is incorporated herein by reference. Referring to FIG. 6, composite cermet materials 74 having an ordered material microstructure comprise a cermet first structural region 76 comprising a hard material selected from the group consisting of cermet materials as described above. A second structural region 78 comprises a material that is different from that used to form the cermet first structural region 40 and is in contact with at least a portion of the first structural region. In an example embodiment, the material used to form the second structural region is a ductile materials such as steel, Co, Ni, Fe, W, Mo, Ti, Ta, V, Nb, and alloys thereof, and the second structural region is substantially continuous around the plurality of first structural regions. The ordered or oriented microstructure of such composite cermet material comprises repeated structural units each made up of the first and second structural regions.

When the elected wear resistant surface is formed from conventional hardfacing, it can be applied to the milled tooth in the conventional manner described above for providing hardfacing. When the elected wear resistant surface is formed from a functionally-engineered material, this can be applied onto a desired underlying substrate according to at least two different methods.

Suitable methods for doing this are disclosed in U.S. Pat. No. 6,615,935, which is incorporated herein by reference. According to a first application method, the wear and fracture resistant materials are first preformed into a green part that is configured to fit over desired surface portions of the milled tooth, e.g., that is configured into the shape of a cap for placement over the milled tooth. The green part is formed into the desired shape by mold process and is placed onto the intended substrate surface, e.g., a bit tooth surface.

A molding technique useful for forming a preformed green part of the wear and fracture resistant material comprises mixing together a desired steel and/or cermet or cermet precursor/constituent powder (useful for forming the desired composite cermet and/or cermet) with a suitable liquefying agent to form a semi-plastic mixture. Suitable composite cermet and/or cermet constituent material powders are the same as those described above.

Suitable liquefying agents useful for making wear and fracture resistant surfaces include those that are capable of blending with the material powder to form a substantially homogeneous mixture, and that can provide flexibility to the solid material (powder) to facilitate shaping and preforming. Additionally, the chosen liquefying agent should have a desirable burnout behavior, enabling it to be removed from the green part during subsequent processing without causing damage to the structure. Suitable liquefying agents include waxes, organic binders, and polymeric binders that are capable of both combining with the material constituent powders to form a solution, and being removed from the solution during further processing so that they do not impair formation of the desired composite material microstructure.

Example polymer binders include can include thermoplastic materials, thermoset materials, aqueous and gelation polymers, as well as inorganic binders. Suitable thermoplastic polymers may include polyolefins such as polyethylene, polyethylene-butyl acetate (PEBA), ethylene vinyl acetate (EVA), ethylene ethyl acetate (EEA), polyethylene glycol (PEG), polysaccharides, polypropylene (PP), poly vinyl alcohol (PVA), polystyrene (PS), polymethyl methacrylate, methylethyl ketone (MEK), poly ethylene carbonate (PEC), polyalkylene carbonate (PAC), polycarbonate, poly propylene carbonate (PPC), nylons, polyvinyl chlorides, polybutenes, polyesters, waxes, fatty acids (stearic acid), natural and synthetic oils (heavy mineral oil), and mixtures thereof. Suitable thermoset plastics useful as the polymer binder may include polystyrenes, nylons, phenolics, polyolefins, polyesters, polyurethanes. Suitable aqueous and gelation systems may include those formed from cellulose, alginates, polyvinyl alcohol, polyethylene glycol, polysaccharides, water, and mixtures thereof. Silicone is an example inorganic polymer binder.

In an example first method where the desired preformed green part is in the shape of a cap, the step of preforming involves taking the semi-plastic mixture and pressing, extruding, and chopping the extruded product into thin disks. Each disk is loaded into a press and is thermoformed into a final green product, e.g., a cap, for placement over at least a portion of a bit tooth by pressing under temperature conditions in the range of from 30 to 150° C. and under pressure conditions in the range of from 100 to 10,000 psi. In an example embodiment, the so-formed green part is in the shape of a cap that is placed over a bit tooth. Again, however, it is to be understood that the green part can be preformed into any shape necessary to cover a desired substrate surface.

The preformed green part is constructed having an accurately controlled and replicable layer thickness. For example, the above-described thermoforming process enables formation of green parts, e.g., caps, having a consistent layer thickness within a range of from 0.05 to 10 millimeters (mm). It is to be understood, however, that the layer thickness may vary from this range depending on such factors as the type of composite cermet and/or cermet materials selected, the location of the wear resistant surface on the milled tooth, and the particular rock bit drilling application.

The preformed green part is positioned over the intended substrate surface, is bonded to the substrate, and is sintered/consolidated by a pressure-assisted sintering process to form the final dense product that provides the desired properties of wear and fracture resistance. The green part can be sintered/consolidated by high-temperature/high-pressure processes known in the art. Other example sintering/consolidation processes useful for forming wear and fracture resistant surfaces of this invention include rapid omnidirectional compaction (ROC) process, hot pressing, infiltration, solid state or liquid phase sintering, hot isostatic pressing (HIP), pneumatic isostatic forging, and combinations thereof. These processes are desired because they are needed to form the desired wear and fracture resistant surface material microstructure.

An example sintering/consolidation process is the ROC process. Example ROC processes are described in U.S. Pat. Nos. 4,945,073; 4,744,943; 4,656,002; 4,428,906; 4,341,557 and 4,142,888, which are each hereby incorporated by reference. The ROC process that may be used involves placing the green part, e.g., the substrate comprising the preformed green part, into a closed die and presintering it at a relatively low temperature to drive off the polymer binder and achieve a density appreciably below full theoretical density.

A special glass powder is loaded into the closed die with the presintered part. The glass powder has a lower melting point than that of the green part. The die is heated to raise the temperature to the desired consolidation temperature, which temperature is also above the melting point of the glass. For example, for a wear resistant composite cermet material comprising WC—Co, the consolidation temperature is in the range of from 1,000 to 1,500° C. The heated die is placed in a hydraulic press having a closed cylindrical die and ram that presses into the die. Molten glass and the green part are subjected to high pressure in the die. The part is isostatically pressed by the liquid glass to pressure as high as 120 kpsi. The temperature capability of the entire process can be as high as 1,800° C. The high pressure is applied for a short period of time, e.g., less than about five minutes and preferably one to two minutes, and isostatically compacts the green part to essentially 100 percent density.

It is to be understood that the above-described sintering/consolidation process is but one method that can be used to form the final wear and fracture resistant surface from the green part, and that other sintering/consolidation methods can be used to achieve the same purpose within the scope of this invention.

As an alternative to applying the preformed green part onto the substrate and subsequently sintering/consolidating the same to form the desired wear and fracture resistant surface, the first application method can be practiced sintering/consolidating the preformed green part prior to being applied onto the desired substrate. An example of such application method involves preforming a green part, e.g., a cap, from a desired composite cermet and/or cermet material as described above, and ROCing the preformed part prior to its placement on the substrate. The pre-consolidated cap is then placed over and attached to the intended substrate surface by brazing process with an appropriate brazing material, e.g., a silver-copper braze.

An advantage of this first method of preforming a green part, e.g., a cap, for subsequent formation of the desired wear and fracture resistant surface is that it does not involve the application method of welding as used with conventional hardfacing to apply conventional hardmetal materials. The avoidance of welding application of the wear and fracture resistant material eliminates the potential for unwanted material microstructure interruptions, caused by the introduction of welding byproducts into the material and welding related thermal effects, which are known sources of material failures due to cracking, chipping and fracture.

An additional advantage of this first method of applying is that it enables production of a wear and fracture resistant material layer thickness that is both reproducible and dimensionally accurate and consistent, thereby helping to reduce or eliminate accelerated wear failures due to surface layer thickness deviations.

According to a second application method, the desired composite cermet and/or cermet material is applied to a desired rock bit substrate in the form of a liquid slurry by dip, spray, or coating process. Like the first method described above, the second method can be achieved by using one or more liquefying agents for purposes of forming a solution from one or more composite material constituent material powders. An example second application method involves slurry coating, whereby a liquefying agent in the form of one or more different polymers or organic binders is used to aid in preparing a solution or slurry useful for forming a green part, e.g., for forming a coating onto an identified substrate surface.

The use of a polymer binder is desired as it introduces flexibility into the process of making a green part by enabling formation of a semi-plastic solution that can either be spray applied or dip applied onto the substrate surface to form a desired wear resistant composite material coating having an accurately controllable layer thickness. For example, polymer-assisted forming enables the application of composite material coatings having a repeatable layer thickness within a coating range of from 0.05 to 10 mm, and more preferably in the range of from about 0.2 to 2 mm. Again, as discussed above with respect to the first application method, it is to be understood that the layer thickness may vary from this range depending on such factors as the type of composite cermet and/or cermet materials selected, the location of the wear resistant material surface on the milled tooth, and the particular rock bit drilling application.

Slurry coating involves the process of: (1) combining a desired material powder, e.g., constituent composite cermet and/or cermet powder like WC grains and Co powder, or WC—Co powder, with a polymer binder; (2) mixing the material powder and polymer binder together to form a semi-plastic solution; and (3) applying the solution to a desired substrate surface by dip, spray, brush, or roll technique.

Once the substrate surface is coated with the composite material solution, the so-formed green part is then consolidated by pressure assisted sintering process as described above to form the final dense product that provides the desired properties of wear and fracture resistance. In an example embodiment, the green part formed according to this second method is consolidated by the ROC process.

Advantages of these application methods, in addition to those discussed above, is that they can be used to provide a green surface on a variety of differently configured, i.e., planar or nonplanar, coatable substrate surfaces formed from a variety of different materials such as cermets, carbides, nitrides, carbonitrides, borides, steel, and mixtures thereof. Another advantage of using the slurry coating method is that it provides a consistent and accurately reproducible method for achieving a desired wear resistant composite material thickness via single or multiple coatings. This in turn provides a wear and fracture resistant milled tooth surface having a dimensionally accurate and repeatable layer thickness, thereby reducing or eliminating altogether material wear failures related to material thickness inconsistencies associated with conventional welding techniques.

Milled teeth comprising wear resistant surfaces formed from the above-described functionally-engineered wear and fracture resistant materials can be further processed by heat treatment to achieve certain physical/mechanical properties to adapt the finished product for use in a particular application.

Milled teeth having selectively positioned wear resistant surfaces formed from functionally-engineered wear and fracture resistant materials can have a surface layer thickness in the range of from 0.5 to 10 mm. It is to be understood that the exact surface layer thickness will vary within this range depending on the choice of composite material, the rock bit substrate, and the rock bit application.

A rock bit comprising milled teeth of this invention, having a functionally-engineered wear and fracture resistant composite cermet material surface, is better understood with reference to the following examples.

EXAMPLE NO. 1

Rock Bit having Milled Teeth Comprising Selectively Positioned Wear Resistant Surface Portions Formed from WC—Co/Steel Functionally-Engineered Wear and Fracture Resistant Composite Cermet Material A wear and fracture resistant composite cermet material solution is prepared by combining approximately 65 percent by weight WC—Co pellets, 35 percent by weight steel powder, and approximately 45 percent by volume paraffin wax and polypropylene. The ingredients are mixed together using a ball mill or other mechanical mixing means. If desired, additional solvents or other types of processing additives, such as lubricants or the like, can be used to aid in the processability of the solution to control solution viscosity and/or to control desired coating thickness. The resulting solution has a semi-fluid consistency.

The solution is further formed into a shape suitable for placement over a selected surface portion of a milled tooth. In this example, the solution is preformed by the thermoforming process described above into the shape of a cap suited for placement over a surface of a milled tooth. The cap is shaped to provide a wear resistant surface shaped like that illustrated in FIGS. 3A to 3C.

The so-formed green part is debinded and presintered at a temperature in the range of from about 800 to 1,100° C. for a period of about 30 to 40 minutes. The debinded green part is applied onto the intended rock bit surface and is sintered/consolidated by the ROC process as described above. The so-formed surface has a composite cermet material microstructure comprising a plurality of cermet first regions made of WC—Co granules that are distributed within a matrix second region made of steel.

EXAMPLE NO. 2

Rock Bit Having Milled Teeth Comprising Selectively Positioned Wear Resistant Surface Portions Formed From WC—Co/Cobalt Functionally-Engineered Wear and Fracture Resistant Composite Cermet Material A wear resistant composite cermet material solution is prepared by combining approximately 65 percent by weight WC—Co pellets, 35 percent by weight cobalt powder, and approximately 45 percent by volume paraffin wax and polypropylene. The ingredients are mixed together using a ball mill or other mechanical mixing means. If desired, additional solvents or other types of processing additives, such as lubricants or the like, can be used to aid in the processability of the solution to control solution viscosity and/or to control desired coating thickness. The resulting solution has a semi-fluid consistency.

The solution is further formed into a shape suitable for placement over an intended surface portion of a milled tooth rock bit. In this example, the solution is preformed by the thermoforming process described above into the shape of a cap suited for placement over a surface of a milled tooth. The cap is shaped to provide a wear resistant surface like that illustrated in FIGS. 3A to 3C. The so-formed green part is debinded and presintered at a temperature in the range of from about 800 to 1,100° C. for a period of about 30 to 40 minutes. The debinded green part is placed over the intended rock bit surface and is sintered/consolidated by the ROC process as described above. The so-formed surface has a composite cermet material microstructure comprising a plurality of cermet first regions made of WC—Co granules that are distributed within a matrix second region made of cobalt.

Figure 7:
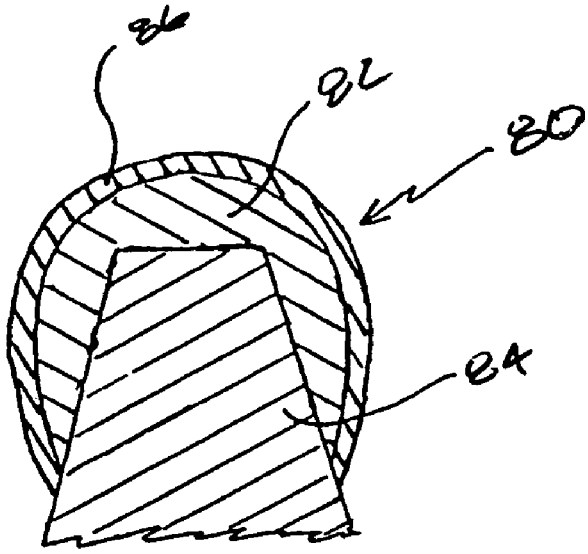
FIG. 7 is a cross sectional side view of a milled tooth of this invention comprising a multilayer wear and fracture resistant material surface.

FIG. 7 illustrates an alternative embodiment steel milled tooth 80 of this invention comprising a dual layer wear resistant surface positioned thereon at the strategically positioned locations discussed above. Specifically, this embodiment milled tooth includes a composite cermet material layer 82 disposed onto a surface of the steel tooth 84, and a cermet material layer 86 disposed onto a surface of the composite cermet layer 82 that forms a final wear and fracture resistant milled tooth surface.

In such milled tooth embodiment, the composite cermet material layer 82 is selected from the same type of wear and fracture resistant materials discussed above for the other milled tooth embodiments. The composite cermet material layer 82 can be formed/applied in the same manner as discussed above. In an example embodiment, the composite cermet material layer 82 is prepared according to the first method in the form of a preformed green part, e.g., a cap.

Figure 8:
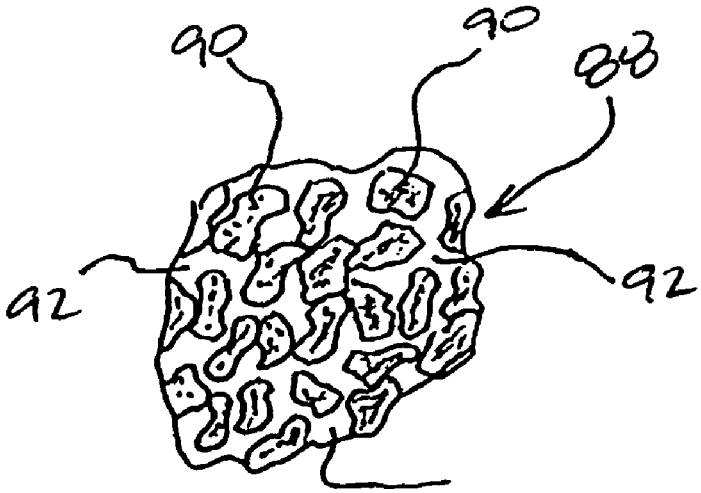
FIG. 8 is a schematic representation of a material microstructure for a wear and fracture resistant cermet material surface used to form milled teeth of this invention.

In such milled tooth embodiment, the cermet material layer 86 is formed from a cermet material. Referring to FIG. 8, example cermet materials suitable for forming wear and fracture resistant surfaces comprise a material microstructure 88 including a plurality of hard phase regions 90, that are bonded together by a softer or more ductile binder region 92. The hard phase regions 90 each comprises a plurality of hard particles that can include those formed from carbides, borides, nitrides, or carbonitrides that include a refractory metal such as W, Ti, Mo, Nb, V, Hf, Ta, and Cr. Example particles useful for forming the hard phase regions include WC, TiC, TaC, $TiB_2$, or $Cr_2C_3$. The binder region 92 can be formed from the group of ductile materials including one or a combination of Co, Ni, Fe, which may be alloyed with each other or with C, B, Cr, Si and Mn. Example cermet materials useful for forming the wear and fracture resistant cermet surface of this invention include WC—Co, WC—Ni, WC—Fe, WC—(Co, Ni, Fe) and their alloys.

In an example embodiment, the cermet material is WC—Co having a material microstructure comprising hard phase regions 90 of tungsten carbide (WC) grains, and a softer or more ductile binder phase region 92 of cobalt (Co) that bonds the WC grains to one another. In an example embodiment, the WC—Co cermet material may comprise less than about 20 percent by weight cobalt, and more preferably in the range of from about 6 to 16 percent by weight cobalt. In a particular example, the WC—Co material comprises approximately 10 percent by weight cobalt. Example WC—Co materials have a WC grain size in the range of from about one to ten micrometers, and can have a Rockwell A hardness in the range of from about 85 to 95, a fracture toughness in the range of from about 9 to 20 $MPaCm^{-1/2}$, and have a wear number in the range of from about 1.5 to 40 (1,000 rev/$cm^3$).

The cermet material can be applied to the surface of the underlying composite cermet layer by the same methods discussed above. For example, the cermet material can be preformed into a green part, e.g., a cap, that is configured for placement over the composite cermet material layer. Alternatively, the cermet material can be applied to the composite cermet material in the form of a coating, e.g., by dip or spray application.

If desired, the composite cermet and cermet materials discussed above can each additionally include cast carbide particles, carburized WC powder, and/or microcrystalline tungsten carbide particles.

The unique properties of cemented tungsten carbide, e.g., toughness, wear and fracture resistance, result from the combination of a rigid carbide network with a tougher metal substructure. These cermet materials comprise a high density of hard phase regions when compared to conventional hardmetal material that are applied by hardfacing method. For example, such cermet materials have a high carbide density, and a reduced mean free path (MFP) between cermet particles or grains of less than about 10 micrometers when compared to conventional hardmetal materials applied by hardfacing method. This relatively high carbide density serves to resist preferential material loss of the ductile phase region, when compared to the lower carbide density conventional hardmetal materials, thereby serving to resist preferential wear of the ductile phase region and increase rock bit service life.

In this embodiment, the cermet material layer is applied to the underlying composite cermet material to provided an enhanced degree of wear resistance thereto. Although the composite cermet material layer has a level of wear resistance that is sufficient for most rock bit drilling applications, there are some extreme drilling applications that call for an even greater level of wear resistance. The cermet material layer is provided in such instances to protect the underlying composite cermet material layer from such extreme drilling applications, thereby serving to enhance the service life of the rock bit.

The composite cermet material layer has a relatively higher level of toughness than that of the cermet material layer. Thus, the composite cermet material layer serves in this embodiment to control crack initiation and propagation caused from impact stresses transmitted to the cermet material layer, thereby also acting to enhance rock bit service life. Additionally, since the composite cermet material layer comprises a material microstructure having a larger proportion of metal than that of the cermet material layer, it serves as a thermally compatible intermediate layer between the steel substrate and largely carbide-containing cermet material to reduce the propensity for unwanted thermal stress cracking to develop in the cermet material layer. This too serves to increase the service life of the rock bit comprising both material layers.

In an example milled tooth embodiment, a functionally-engineered wear and fracture resistant surface comprises a composite cermet material layer 82 having a material microstructure as discussed above including a plurality of carbide (e.g., WC—Co) granules distributed within a matrix binder material phase (e.g., steel or cobalt), and cermet material layer 86 having a material microstructure as discussed above including a plurality of carbide grains (e.g., WC) bonded together by a ductile binder metal (e.g., cobalt). In this embodiment, the two material layers are functionally engineered to provide a high level of wear resistance at the rock bit surface (by presence of the high carbide density cermet material) with an increased degree of toughness below the surface (by the presence of the composite cermet material) to control the initiation and propagation of cracks.

Each material layer 82 and 86 can be sintered/consolidated, e.g., by ROC process, independently, or all of the layers can be applied and then sintered/consolidated in a single step, e.g., by a single ROC process as described in Example No. 3.

Milled teeth comprising selectively positioned dual-layer functionally-engineered wear and fracture resistant surfaces comprise a composite cermet material layer having a layer thickness of from about 0.5 to 10 mm, and a cermet material layer thickness of from about 0.2 to 2 mm.

It is to be understood that while a dual-layer milled tooth wear resistant surface has been disclosed above and illustrated in FIG. 7, as comprising two different composite material layers, wear resistant surfaces useful for forming milled teeth of this invention can comprise more than two material layers.

A milled tooth, comprising a dual-layer selectively placed functionally-engineered wear and fracture resistant surface, is better understood with reference to the following example.

EXAMPLE NO. 3

Milled Tooth with Selectively Positioned Dual-Layer Wear Resistant Surface Portions Formed From WC—Co/Steel and WC—Co Functionally-Engineered Wear and Fracture Resistant Material A preformed cap is prepared, according to the practice of Example No. 1, comprising a plurality of WC—Co granules distributed within a steel matrix. The green cap is debinded and presintered at a temperature in the range of from about 800 to 1,100° C. for a period of about 30 to 40 minutes. A wear resistant cermet material solution is prepared by combining in the range of from 30 to 90 percent by volume cermet constituent powder, e.g., WC powder and Co powder. The powder comprises approximately 10 percent by weight cobalt. The remaining volume of the coating solution is polymer binder. In an example embodiment, in the range of from 50 to 75 percent by volume of WC and Co powder is used. In an example embodiment, the polymer binder solution comprises approximately 20 percent by weight poly-propylcarbonate in methyl ethyl ketone (MEK) solution. The embodiment can use binder solutions containing from 5 to 50 weight percent polymer in solution. Moreover, solvents other than MEK may be utilized.

The polymer binder solution is combined with the material powder element and the ingredients are mixed together using a ball mill or other mechanical mixing means. If desired, additional solvents or other types of processing additives, such as lubricants or the like, can be used to aid in the processability of the solution to control solution viscosity and/or to control desired coating thickness. The resulting solution has a semi-fluid consistency.

The outside surface of the green composite cermet cap is dipped into the cermet solution for a period of time that will vary depending on the make-up of the solution. In the example embodiment, where binder comprises MEK present in the above-identified proportions, the cap is dipped into the solution for a period of approximately 5 seconds. The dipped surface is removed from the solution and allowed to dry for a period of time, e.g., in the example embodiment, approximately 1 minute. Again, drying time is understood to vary depending on the particular solution make up.

The dipped cap is placed onto a milled tooth and is sintered/consolidated by the ROC process as described above to provide a functionally-engineered wear and fracture resistant surface disposed over at least a portion of the tooth having a carbide grain MFP of less than 10 micrometers, and displaying improved properties of wear and fracture resistance when compared to a conventional hardmetal materials applied by hardfacing method.

In an alternative milled tooth embodiment, the composite cermet material useful for forming the wear resistant surface is replaced with a cermet material similar to that described above and illustrated in FIG. 7 that is used to form the wear resistant surface layer 86. Thus, in this alternative embodiment the wear and fracture resistant surface is formed from a cermet material.

The cermet material selected to form the wear resistant surface can be formed from the same types of cermet materials described above, and has the same material microstructure as described above and illustrated in FIG. 8. However, because the cermet material is placed in direct contact with the underlying steel substrate, i.e., there is no intermediate composite cermet material layer, it is desired that the cermet material have a relatively higher metal content than the cermet material layer used to form a wear and fracture resistant layer over the composite cermet material. A higher metal content is desired to improve the thermal compatibility between cermet material and the steel substrate.

In an example embodiment, cermet materials useful for forming a wear and fracture resistant surface, according to a third embodiment of this invention, may comprise in the range of from about 10 to 40 percent by volume metal. In an example embodiment, the cermet material is WC—Co comprising approximately 15 to 40 percent by volume cobalt.

Wear resistant surfaces formed from the cermet material can be applied to a milled tooth surface according to the same application methods described above, e.g., in the form of a preformed cap by thermoforming process, or in the form of a dip or spray applied coating by polymer-assisted forming process. In each case, the material is applied to the above-described selective portions of the milled tooth surface. The method for making and applying the cermet material will depend on such factors as the type of cermet material selected, the position of the cermet material on the milled tooth, and the particular drilling application.

Generally speaking, the cermet material can be made and applied in the form of a preformed cap when seeking to form a surface layer having a thickness of above about 0.5 mm, and is applied in the form of a dip or spray coating when seeking to form a surface layer having a thickness below about 0.5 mm. In an example embodiment, the cermet surface layer is formed and applied by slurry coating method and has a material layer thickness of approximately 3 mm. The green surface layer is sintered and consolidated by ROC process as described above.

Milled tooth bits, comprising the above-identified wear resistant materials that are placed over select portions of the tooth surface, provide a desired degree of wear resistance to areas of the tooth thought to be important, while at the same time minimizing the total amount of wear resistant materials that is used. This has the desired effect of increasing the cross-sectional thickness of a milled tooth by only that amount needed to provide the desired level of wear resistance, thereby not having an adverse impact on the ROP during drilling operation. Additionally, using the above-described functionally-engineered composite cermet and/or cermet materials as an alternative to hardfacing to form the wear resistant material provides the following advantages: (1) they provide a consistent and uninterrupted material microstructure that does not suffer from the unwanted effects of weld applying the material, e.g., the introduction of unwanted material contaminants and thermal stress-related cracks into the material microstructure; (2) they provide a surface layer having that is functionally engineered to control/resist the preferential wear and material loss of the materials forming the surface layer; and (3) they provide an ability to achieve a reproducible and dimensionally accurate and consistent surface layer thickness.

As a result of these advantages, rotary cone drill bits comprising milled teeth having a selectively positioned wear and fracture resistant composite cermet and/or cermet material surface provides improved properties of wear and fracture resistance when compared to conventional hardfacing formed from conventional hardmetal materials, thereby increasing the resulting service life of rock bits comprising the same.

Other modifications and variations of milled teeth of this invention comprising selectively position wear resistant surfaces will be apparent to those skilled in the art. It is, therefore, to be understood that within the scope of the appended claims, this invention may be practiced otherwise than as specifically described.

What is claimed is:

1. A rotary cone drill bit comprising a plurality of cutting elements projecting outwardly from rotary cones, at least one of the cutting elements comprising:

a crest positioned at a tip portion of cutting element;

a first flank surface extending from the crest to the cone;

a second flank surface opposite from the first flank surface and extending from the crest to the cone;

edge surfaces extending from the crest to the cone and interposed between each of first and second flank surfaces;

corners extending from the crest to the cone and defined by the interface between the first and second flank surface and the edge surfaces;

a wear resistant surface disposed on the crest and a portion of one or more of the corners, wherein the wear resistant surface extends from the crest to cover a partial portion of the first flank surface that is less than about ⅓ of the length of the first flank surface as defined between the crest and the cone.

2. The drill bit as recited in claim 1 wherein the wear resistant surface extends from the crest to cover a majority of the length of each corner.

3. The drill bit as recited in claim 1 wherein the wear resistant surface extends to cover at least 75 percent of the length of each corner as defined between the crest and the cone.

4. The drill bit as recited in claim 1 wherein a majority of the surface area of one or more of the first and second flank surfaces and the edge surfaces is not covered by the wear resistant surface.

5. The drill bit as recited in claim 1 wherein the wear resistant surface extends to cover greater than about ⅓ of the second flank surface as defined between the crest and the cone.

6. The drill bit as recited in claim 5 wherein the wear resistant surface extends from the crest to cover at least 75 percent of the length of each corner as defined between the crest and the cone.

7. The drill bit as recited in claim 1 wherein the cutting element is formed from steel, and the wear resistant surface is formed from a material comprising a plurality of hard phase grains bonded together by a binder phase.

8. The drill bit as recited in claim 7 wherein the hard grains are selected from the group of materials consisting of W, Ti, Mo, Nb, V, Hf, Ta and Cr carbides, and the binder phase is selected from the group consisting of steel, Co, Ni, Fe, C, B, Cr, Si, Mn and alloys thereof.

9. The drill bit as recited in claim 8 wherein the hard grains are WC and the binder phase is Co.

10. The drill bit as recited in claim 1 wherein the cutting element is formed from steel, and the wear resistant surface is formed from a cermet composition comprising a plurality of first regions distributed within a continuous matrix second region, wherein the first regions are formed from a cermet material, and the second region is formed from a material that is relatively more ductile than the first regions.

11. The drill bit as recited in claim 10 wherein the cermet material comprises a plurality of hard grains bonded together by a binder phase, the hard grains being selected from the group of materials consisting of W, Ti, Mo, Nb, V, Hf, Ta and Cr carbides; and the binder phase being selected from the group of materials consisting of Co, Ni, Fe, C, B, Cr, Si, Mn and alloys thereof.

12. The drill bit as recited in claim 11 wherein the second region is formed from materials selected from the group consisting of steel, Co, Ni, Fe, W, Mo, Ti, Ta, V, Nb, C, B, Cr, Mn and alloys thereof.

13. The drill bit as recited in claim 1 wherein the wear resistant surface is formed from a composite material made by the process of:

combining powders selected from the group consisting of carbides, borides, nitrides, carbonitrides, refractory metals, cermets, Co, Fe, Ni, steel, and combinations thereof, to form a material mixture;

applying the material mixture onto the cutting element surface when the cutting element is in a pre-existing rigid state; and pressurizing the applied mixture under conditions of elevated temperature to form the wear resistant surface.

14. The drill bit as recited in claim 13 wherein before the step of applying, the mixture is preformed into a shape that complements selected surfaces of the cutting element, and during the step of applying, the preformed shape is placed over the selected surfaces.

15. The drill bit as recited in claim 14 wherein the preformed shape is in the form of a cap that is configured to cover the cutting element crest and at least a portion of the four corners.

16. The drill bit as recited in claim 13 wherein during the step of applying, the material mixture is in the form of a slurry that is applied to form a coating on the selected surfaces of the cutting element.

17. A rotary cone drill bit comprising a plurality of cutting elements projecting outwardly from rotary cones, at least one of the cutting elements comprising:

a crest positioned at a tip portion of cutting element;

a first flank surface extending from the crest to the cone;

a second flank surface opposite from the first flank surface and extending from the crest to the cone;

edge surfaces extending from the crest to the cone and interposed between each of first and second flank surfaces;

corners extending from the crest to the cone and defined by the interface between the first and second flank surface and the edge surfaces;

a wear resistant surface disposed on the crest and a portion of one or more of the corners, wherein the wear resistant surface extends from the crest to cover a minority of the surface area of the first flank surface.

18. A milled tooth bit comprising:

a plurality of steel cutting teeth projecting outwardly from rotary cones, at least one of the cutting teeth comprising:

a crest positioned at a tip portion of cutting element;

a first flank surface extending from the crest to the cone;

a second flank surface opposite from the first flank surface and extending from the crest to the cone;

edge surfaces extending from the crest to the cone and interposed between each of first and second flank surfaces;

corners extending from the crest to the cone and defined by the interface between the first and second flank surface and the edge surfaces;

a wear resistant surface disposed onto the crest and extending along at least 75 percent of the length of one or more of the corners as defined between the crest and the cone, wherein the wear resistant surface extends from the crest to cover a minority of the surface area of the first flank surface and a majority surface area of the second flank surface.

19. The drill bit as recited in claim 18 wherein the wear resistant surface is formed from a material comprising a plurality of hard phase grains bonded together by a binder phase.

20. The drill bit as recited in claim 19 wherein the hard grains are selected from the group of materials consisting of W, Ti, Mo, Nb, V, Hf, Ta and Cr carbides, and the binder phase is selected from the group consisting of steel, Co, Ni, Fe, C, B, Cr, Si, Mn and alloys thereof.

21. The drill bit as recited in claim 20 wherein the hard grains are WC and the binder phase is Co.

22. The drill bit as recited in claim 18 wherein the wear resistant surface is formed from a cermet composition comprising a plurality of first regions distributed within a continuous matrix second region, wherein the first regions are formed from a cermet material, and the second region is formed from a material that is relatively more ductile than the first regions.

23. The drill bit as recited in claim 22 wherein the cermet material comprises a plurality of hard grains bonded together by a binder phase, the hard grains being selected from the group of materials consisting of W, Ti, Mo, Nb, V, Hf, Ta and Cr carbides; and the binder phase being selected from the group of materials consisting of Co, Ni, Fe, C, B, Cr, Si, Mn and alloys thereof.

24. The drill bit as recited in claim 23 wherein the second region is formed from materials selected from the group consisting of steel, Co, Ni, Fe, W, Mo, Ti, Ta, V, Nb, C, B, Cr, Mn and alloys thereof.

25. The drill bit as recited in claim 19 wherein the wear resistant surface is formed from a composite material made by the process of:

combining powders selected from the group consisting of carbides, borides, nitrides, carbonitrides, refractory metals, cermets, Co, Fe, Ni, steel, and combinations thereof, to form a material mixture;

applying the material mixture onto the cutting element surface when the cutting element is in a pre-existing rigid state; and pressurizing the applied mixture under conditions of elevated temperature to form the wear resistant surface.

26. The drill bit as recited in claim 25 wherein before the step of applying, the mixture is preformed into a shape that complements selected surfaces of the cutting teeth, and during the step of applying, the preformed shape is placed over the selected surfaces.

27. The drill bit as recited in claim 25 wherein during the step of applying, the material mixture is in the form of a slurry that is applied to form a coating on the selected surfaces of the cutting teeth.

* * * * *